United States Patent [19]

Parks et al.

[11] Patent Number: 4,963,814

[45] Date of Patent: Oct. 16, 1990

[54] REGULATED BIFURCATED POWER SUPPLY

[75] Inventors: Robert A. Parks, Springport; Bradley E. White, Zionsville, both of Ind.

[73] Assignee: Boehringer Mannheim Corporation, Indianapolis, Ind.

[21] Appl. No.: 451,107

[22] Filed: Dec. 15, 1989

[51] Int. Cl.[5] ..... G05F 1/613

[52] U.S. Cl. ..... 323/274; 323/275; 307/43; 307/49; 307/77

[58] Field of Search ..... 323/273, 274, 275, 276, 323/280, 281; 307/43, 48, 49, 63, 77

[56] References Cited

U.S. PATENT DOCUMENTS

| | | | |
|---|---|---|---|
| 3,343,073 | 9/1967 | Mesenheimer | 307/49 |
| 3,459,957 | 8/1969 | Kelley | 307/77 |
| 3,495,157 | 2/1970 | Nercessian | 323/275 |
| 3,704,381 | 11/1972 | Nercessian | 323/275 |
| 3,787,730 | 1/1974 | Ray et al. | 307/77 |
| 4,288,739 | 9/1981 | Nercessian | 323/275 |
| 4,812,672 | 3/1989 | Cowan et al. | 307/43 |

*Primary Examiner*—Peter S. Wong

*Attorney, Agent, or Firm*—Perman & Green

[57] ABSTRACT

A regulated power supply employs two separate sources of power which are serially connected by a variable impedance element, such as a transistor, connected between the two power sources. Output voltage of the power supply is equal to the sum of the individual power supply voltages minus a voltage drop across the variable impedance element. A sensor circuit employing standby and active mode branches is coupled between output terminals of the power supply for control of the variable impedance element. The active branch of the sensor is switchably connected to an output power terminal of the supply so as to be operative only during the active mode. The standby branch comprises a resistive network coupled to a reference diode while the active branch comprises a feedback amplifier coupled to the reference diode.

11 Claims, 1 Drawing Sheet

REGULATED BIFURCATED POWER SUPPLY

REFERENCE TO RELATED APPLICATIONS

This invention is related to inventions described in: U.S. patent application Ser. No. 07/451,212, filed Dec. 15, 1989, entitled "Analog To Digital Conversion With Noise Reduction" by Parks.

U.S. patent application Ser. No. 07/451,108, filed Dec. 15, 1989, entitled "Biosensor Electrode Excitation Circuit" by Parks and White.

U.S. patent application Ser. No. 07/451,309, filed Dec. 15, 1989, entitled "Biosensing Instrument And Method" by White.

BACKGROUND OF THE INVENTION

This invention relates to regulated power supplies and, more particularly, the use of a standby mode and an active mode of regulation in a power supply employing two separate sources of power arranged in series.

Regulated power supplies are employed in numerous applications for maintaining a steady source of voltage for use in providing power, particularly, to electronic circuits. As is well known, electronic circuits may be sensitive to the magnitude of a line voltage resulting in variation of an output signal of the circuit due to a variation in the line voltage. Such disturbances in the output signals of electronic circuits, such as electronic circuits employed in biological measurements can result in a possible mis-diagnosis of a person's ailment, by way of example. Of course, there are many other situations in which a variation in a signal measurement caused by a perturbation of line voltage can have a deleterious effect.

While numerous circuits are available for the construction of regulated power supplies, they have been implemented under constraints wherein a regulating element, such as a power transistor, is placed in an output line of the power supply with the result that regulation circuitry which controls the power transistor must be configured to operate essentially between output terminals of the supply and through a much larger voltage than may be desired. In addition, it may be difficult to develop the desired control signal for the power transistor in the situation wherein one terminal thereof is at an output terminal of the supply. As a result, control of the output voltage may not be attainable as readily as desired.

SUMMARY OF THE INVENTION

The foregoing problem is overcome and other advantages are provided by a regulated power supply circuit which, in accordance with the invention, employs two sources of power which are arranged in series with a variable impedance element connected between the two sources of power. The two sources of power may be batteries, and the variable impedance element may be a transistor. A sensor of output voltage is employed, the sensor having a zener reference or band-gap reference diode for regulating the output voltage. A signal outputted by the sensor is applied to a variable impedance element to induce a relatively small variation in voltage drop across the impedance element to compensate for a variation in total output voltage of the supply. The total output voltage is equal to the sum of the voltages of the individual voltage sources minus the voltage drop across the variable impedance element.

In accordance with a further feature of the invention, the sensor is constructed of two branches wherein one branch employs a resistive circuit providing a standby output signal for regulation of the power supply during a standby mode of operation. The second branch of the sensor employs a feedback amplifier for higher precision control of the output voltage during an active mode of operation. The feedback amplifier provides an active output signal for the variable impedance element during the active mode. The second branch of the sensor is switchably connected to an output power line so as to be active only during the active mode while the standby branch is active in both the standby and the active modes. A summing circuit combines the standby and the active output signals to provide a combined output signal for control of the impedance element.

BRIEF DESCRIPTION OF THE DRAWING

The foregoing aspects and the other features of the invention are explained in the following description taken in connection with the accompanying drawing wherein the sole FIGURE is an electrical schematic diagram of the regulated power supply of the invention.

DETAILED DESCRIPTION

Figure 1:
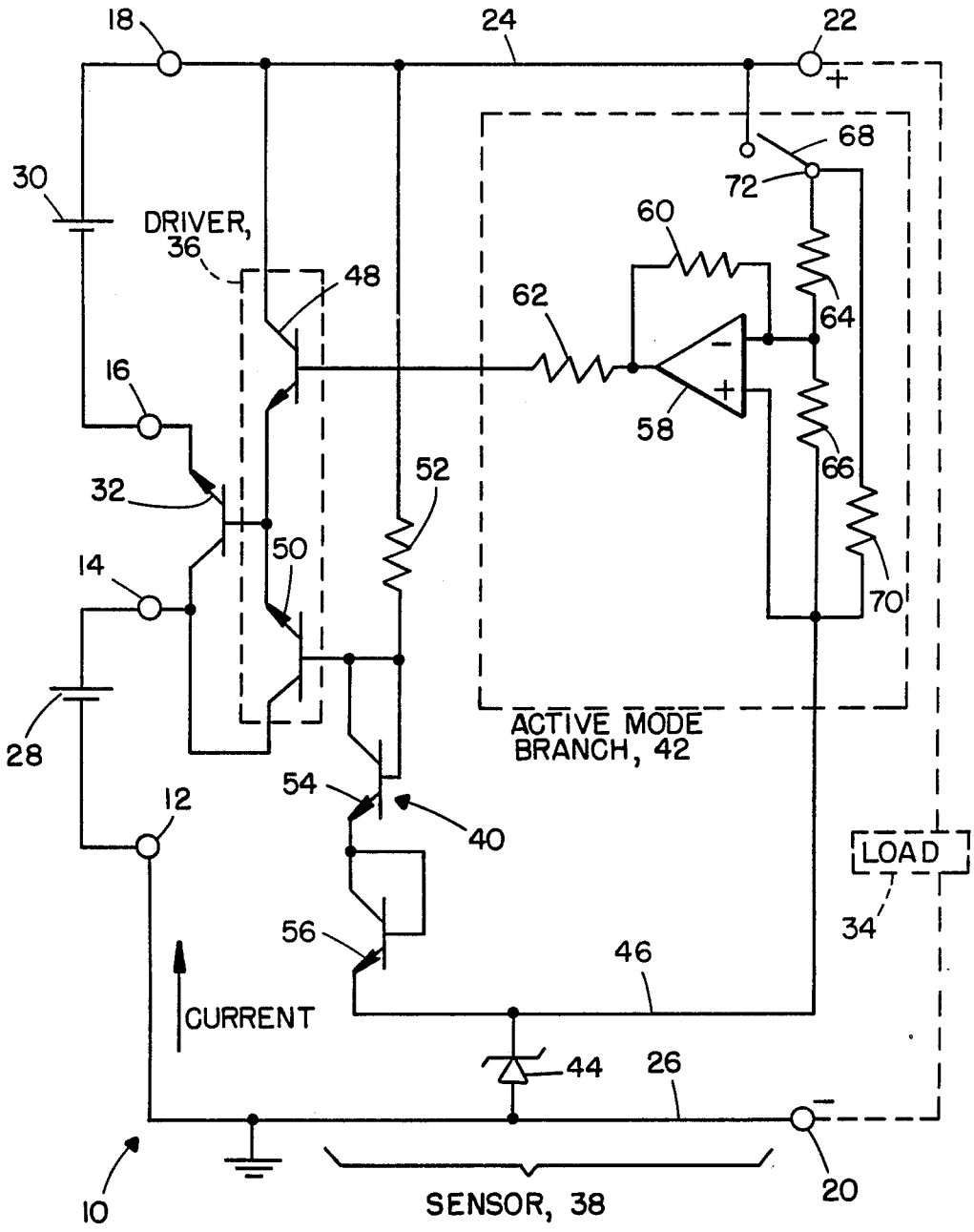

With reference to the drawing, there is shown a regulated power supply 10 having a first input terminal 12, a second input terminal 14, a third input terminal 16, a fourth input terminal 18, a first output terminal 20 and a second output terminal 22. The fourth input terminal 18 is connected via a line 24 to the second output terminal 22. The first input terminal 12 is connected via a line 26 to the first output terminal 20. The input terminals 12 and 14 constitute a first input terminal pair for connection with an external source of power shown as a first battery 28. The two input terminals 16 and 18 constitute a second input terminal pair for connection with a second external source of power shown as a second battery 30. A variable impedance element interconnects the two input terminals 14 and 16, the variable impedance element being provided in a preferred embodiment of the invention by use of a power transistor 32.

In accordance with a feature of the invention, the transistor 32 serves to serially connect two external sources of power, the two batteries 28 and 30, between the lines 24 and 26 connected to the output terminals 22 and 20. Current flowing into a load 34, indicated in phantom, connected to the output terminals 20 and 22 flows through the two batteries 28 and 30 and also through the transistor 32. The direction of current flow is indicated by an arrow adjacent the input terminal 12. The total voltage appearing across the output terminals 20 and 22 is equal to the sum of the voltage rises across the two batteries 28 and 30 minus the voltage drop between the collector and the emitter terminals of the transistor 32. The emitter terminal of the transistor 32 is connected to the terminal 16 and to the collector terminal of the transistor 32 is connected to the terminal 14.

By varying the voltage drop across the transistor 32, the total output voltage appearing across the output terminals 20 and 22 can be varied. It is anticipated that during the normal lifetime of a battery, such as the batteries 28 and 30, there will be a variation in output voltage. While such variation in battery voltage is relatively small, as a percentage of the total battery voltage, such variation in voltage may well be excessive for operating electrical equipment employed in making sensitive precise measurements, for example, such as biological testing. Application of base current to the transistor 32 serves to alter the voltage drop appearing between the collector and the emitter terminals so as to compensate for aging in the batteries. A variation in voltage drop across the transistor 32 without significant change in the current through the transistor 32 constitutes a change of impedance of the transistor 32 as viewed between the collector and the emitter terminals. Thus, it can be appreciated that a device other than the transistor 32 may be employed as long as the impedance thereof can be readily varied in response to a signal applied to a control terminal thereof.

In order to provide the requisite base drive current to the transistor 32 for regulation of the output voltage of the supply 10, the supply 10 further comprises a driver 36, and a sensor 38 of the output voltage of the supply 10. The sensor 38 is composed of two branches, namely, a standby branch 40 and an active-mode branch 42. The two branches 40 and 42 are connected via a common reference element in the form of a band-gap diode 44 which operates in the manner of a zener diode to provide a voltage reference on line 46 in response to current coupled to the diode 44 via one or both of the branches 40 and 42.

The driver 36 comprises two transistors 48 and 50 serially connected in back-to-back arrangement with their emitter terminals connected together and to the base terminal of the transistor 32. The standby branch 40 comprises a resistor 52 serially connected to the diode 44 by a pair of transistors 54 and 56 which are connected together in series to function as a diode. The collector terminal of the transistor 54 is connected to the resistor 52 and to a base terminal of the transistor 50, the base terminal of the transistor 54 is connected directly to the collector terminal of the transistor 54. The emitter terminal of the transistor 54 is connected to the collector terminal of the transistor 56, the collector terminal of the transistor 56 being connected directly to the base terminal of the transistor 56. The emitter terminal of the transistor 56 is connected to the diode 44.

The active-mode branch 42 of the sensor 38 comprises an operational amplifier 58 having inverting and non-inverting input terminals. A feedback resistor 60 is connected between the inverting input terminal and the output terminal of the amplifier 58 to form the circuit of a feedback amplifier. The output terminal for the amplifier 58 is connected via a resistor 62 to the base terminal of the transistor 48. A resistive divider circuit comprising to resistors 64 and 66 is connected in series with a switch 68 serially between the lines 24 and 46. A junction between the resistors 64 and 66 is connected to the inverting input terminal 72 of the amplifier 58. A further resistor 70 is connected between a terminal 72 of the switch 68 and the line 46. The non-inverting input terminal of the amplifier 58 is also connected to the line 46.

The operation of the active-mode branch 42 is as follows. Upon closure of the switch 68, current flows from the line 24 via the switch 68 through the resistor 70 to the diode 44. In addition, there is current supplied to the diode 44 via the standby branch 40. The combination of these currents produces a sufficient total current to the diode 44 so that it functions as a highly accurate, low-impedance voltage reference element. The resistors 64 and 66 provide a fraction of the voltage between lines 24 and 26 to the inverting input terminal for the amplifier 58. Since the voltage drop between the lines 46 and 26 is fixed by the reference level of the diode 44, the voltage presented to the inverting input terminal of the amplifier 58 is an accurate representation of the output voltage of the supply 10. Since the non-inverting input terminal of the amplifier 58 is connected directly to line 46, the output voltage of the amplifier 58 is directly proportional to the difference of potential between the lines 24 and 46, the magnitude of the output voltage of the amplifier 58 being determined by the gain of the amplifier. The gain of the amplifier 58 is determined by the ratio of resistance of the resistor 60 and the input resistance to the amplifier 58. The feedback characteristic of the amplifier 58 ensures that its output voltage precisely tracks all variations of voltage which may be present at the output terminals 22 and 20. The output voltage of the amplifier 58 is coupled via the resistor 62 to the driver 36, the resistor 62 coupling current from the amplifier 58 directly to the base terminal of the transistor 48. During standby operation of the power supply 10, the switch 68 is placed in the open position and amplifier 58 is disabled, in which case no current is supplied by the amplifier 58 to the transistor 48.

In the standby branch 40, the voltage drop across the series connection of the two transistors 54 and 56 is added to the reference voltage. Driver transistor 50 provides base current to transistor 32 such that the voltage level at terminal 16 is equal to the reference voltage of diode 44 at line 46. The output voltage is then the sum of the reference voltage and the voltage of battery 30 voltage. In addition, the relatively low value of current supplied by the branch 40 to the diode 44 in the standby mode accomplishes a saving of current and of stored energy in the batteries 28 and 30, but at the expense of reduced precision regulation of the output voltage 44. Therefore, in the standby mode, the variations in output voltage is reduced. This is adequate control for operation of the load 34 in a standby mode. However, when the load 34 is to be operated in an active mode wherein, the load 34 must operate under high precision and accuracy, the power supply 10 is placed in the active mode to provide the high accuracy and precision of regulation of the output voltage of the supply 10.

In the active mode, transistor 48 supplies all base drive to transistor 32. Transistor 50 is off due to a negative base-emitter bias. It is verified readily by inspection that a reduction in output voltage at line 24 results in an increase of voltage at the base terminal of the transistor 48 and a decrease in voltage at the base terminal of the transistor 50. When the branch 42 is deactivated, the drop in voltage at line 24 still results in a drop in voltage at the base terminal of the transistor 50. This results in a raising of the voltage at the base terminal at the transistor 32 in both the standby and the active modes. The raising of the voltage at the base terminal at the transistor 32 results in an increased current flow through the transistor 32, a decreased impedance between collector and emitter terminals, and a decreased voltage drop between the input terminals 14 and 16. Since the voltage drop between the input terminals 14 and 16 has been reduced, the total voltage between the input terminals 12 and 18 has been increased. This compensates for the decrease in the output voltage of the power supply 10.

As a further feature of the invention, it is noted that in the event that one of the batteries 28 or 30 is inserted inadvertently with its polarity reversed, the transistor 32 in combination with the transistors 48 and 50 of the driver 36 do not provide a path of current flow in the reverse direction. This protects the load 34 from incorrect polarity.

Let it be understood that the foregoing description is only illustrative of the invention. Various alternatives and modifications can be devised by those skilled in the art without departing from the spirit of the invention. Accordingly, the present invention is intended to embrace all such alternatives, modifications and variances which fall within the scope of the appended claims.

What is claimed is:

1. A regulated power supply comprising:

a first input terminal, a second input terminal, a third input terminal and a fourth input terminal, said first and said second input terminals constituting a first input terminal pair for receiving a first input voltage, said third and said fourth input terminals constituting a second input terminal pair for receiving a second input voltage;

a variable impedance means connected between said second input terminal and said third input terminal, said variable impedance means providing a path of current flow between said second input terminal and said third input terminal and introducing a voltage drop along the path in a direction of the current flow, the power supply providing an output voltage comprising the sum of said first and said second input voltages minus said voltage drop of said impedance means;

means for sensing said output voltage;

driver means coupled between said sensing means and said impedance means for operating said impedance means to increase the voltage drop in response to a sensed increase of said output voltage by said sensing means, thereby to regulate the output voltage of the power supply.

2. The power supply according to claim 1 wherein said sensing means includes a voltage-reference element, and a first sensor output means connected to said voltage-reference element for outputting a first sensor voltage to said driver means based on a difference between the output voltage of the power supply and a reference voltage of said voltage-reference element.

3. A power supply according to claim 2 wherein said sensing means is connected between said first input terminal and said fourth input terminal, said sensing means further including a second sensor output means switchably connected between said fourth input terminal and said first input terminal for outputting a second sensor voltage to said driver means based on a difference between the output voltage of the power supply and the reference voltage of said voltage reference element; and said first sensor output means is operative during a standby mode and an active mode of operation of the power supply, said second sensor output means being operative only during said active mode to provide increased precision to a regulation of the output voltage of the power supply during said active mode.

4. A power supply according to claim 3 wherein said first sensor output means and said second sensor output means each include means for supplying current to said reference-voltage element.

5. A power supply according to claim 4 wherein said reference-voltage element comprises a band-gap diode, and said means for supplying current in each of said sensor output means to said reference-voltage element is a resistor.

6. A power supply according to claim 5 further comprising a switch connecting said sensing means to said fourth input terminal, the resistor of said current supplying means of said first sensor output means being connected directly to said fourth input terminal, and the resistor of said current supplying means of said second sensor output means being connected via said switch to said fourth input terminal.

7. A power supply according to claim 3 further comprising a switch connecting said sensing means to said fourth terminal; and wherein said second sensor output means comprises a feedback amplifier having two input terminals, a first of the feedback amplifier input terminals being connected via said switch to said fourth input terminal of the power supply, and a second of the feedback amplifier input terminals being connected to said voltage-reference element.

8. A power supply according to claim 7 wherein said second sensor output means further comprises a resistive voltage divider interconnecting said first input terminal of said amplifier to said switch.

9. A power supply according to claim 3 wherein said driver means includes a first transistor and a second transistor with respective emitter terminals connected to an input terminal of said impedance means, said first and said second transistors having base terminals connected respectively to said second and said first sensor output means, a collector terminal of said first transistor being connected to said fourth input terminal of the power supply, and a collector terminal of said second transistor being connected to said second input terminal of the power supply.

10. A power supply according to claim 9 wherein said impedance means comprises a transistor having a base terminal serving as the input terminal of said impedance means, said transistor of said impedance means including a collector terminal and an emitter terminal constituting a collector-emitter terminal pair connected between said second and said third input terminals of the power supply.

11. A power supply according to claim 10 wherein said first sensor output means comprises a current-feed resistor and a diode means serially connected with said current-feed resistor for supplying current to said voltage-reference element, a junction of said diode means with said current-feed resistor serving as an output terminal of said first sensor output means for connection to said driver means.

* * * * *